US006855095B2

(12) United States Patent
Chang

(10) Patent No.: US 6,855,095 B2
(45) Date of Patent: Feb. 15, 2005

(54) FOLDING MECHANISM FOR TREADMILLS

(76) Inventor: Huang-Tung Chang, P.O. Box 487, Chang-Hua City 500 (TW)

( * ) Notice: Subject to any disclaimer, the term of this patent is extended or adjusted under 35 U.S.C. 154(b) by 0 days.

(21) Appl. No.: 10/651,960

(22) Filed: Sep. 2, 2003

(65) Prior Publication Data

US 2004/0192513 A1 Sep. 30, 2004

(30) Foreign Application Priority Data

Mar. 17, 2003 (TW) ..... 92204307 U

(51) Int. Cl.[7] ..... A63B 22/00
(52) U.S. Cl. ..... 482/54
(58) Field of Search ..... 482/51, 54

(56) References Cited

U.S. PATENT DOCUMENTS 6,461,275 B1 * 10/2002 Wang et al. ..... 482/8
6,475,121 B2 * 11/2002 Wang et al. ..... 482/54
6,527,679 B2 * 3/2003 Wang et al. ..... 482/54
6,592,496 B1 * 7/2003 Tsou ..... 482/54
6,638,200 B2 * 10/2003 Chang ..... 482/54
6,695,751 B1 * 2/2004 Hsu ..... 482/54
6,726,602 B2 * 4/2004 Chang ..... 482/54

* cited by examiner

*Primary Examiner*—Stephen R. Crow

(57) ABSTRACT

A treadmill includes a base having two side rails and two posts extend from the two side rails. Two transverse bars are connected between the two side rails. Two guide members are connected between the two transverse bars and a motor is fixed to the base. A frame of the running belt is located between the two side rails of the base and a connection board is connected between two sides of the frame. Two connection plates are respectively connected to the two sides of the frame and pivotably connected to the posts. A movable member is driven by the motor and movable on the two guide members. Two arms connected to the movable member are pivotably connected to the connection board so that when the movable member is moved, the frame pivoted by the arms.

4 Claims, 4 Drawing Sheets

FOLDING MECHANISM FOR TREADMILLS

FIELD OF THE INVENTION

The present invention relates to folding mechanism far treadmills and includes a movable member which is driven by a motor and connected to an end of the frame so as to easily pivoting the frame of the treadmills.

BACKGROUND OF THE INVENTION

A conventional treadmill generally includes a base which has two side rails and two posts are connected on the two side rails. A control panel and a handle are connected between the two posts. A frame has two sides and a running belt is reeved onto two ends of the frame. The user is running on the running belt and the data of speed, calorie consuming and the rate of slope can be displayed on the control panel. The frame has one end pivotably connected between the two side rails of the base so that the frame can be pivoted upright when not in use so as to reduce the space occupied. The frame of treadmills is so heavy that the user cannot fold or unfold the, treadmill easily. Therefore, a folding mechanism is needed, especially when the frame is folded at a large angle, the user has to support the frame and this is not an easy job for most of the users. Besides, when an electrical folding mechanism is chosen, some inherent shortcomings are involved which includes too many parts, high cost, and high maintenance fee is required.

The present invention intends to provide a folding mechanism which has less number of parts and is easily to fold or unfold the frame.

SUMMARY OF THE INVENTION

In accordance with one aspect of the present invention, there is provided a treadmill which comprises a base having two side rails and two posts extend from the two side rails. Two transverse bars are connected between the two side rails. Two guide members are connected between the two transverse bars and a motor is fixed to the base.

A frame connected to a running belt is located between the two side rails of the base and a connection board is connected between two sides of the frame. The connection board is located close to an end of the base and the posts. Two connection plates are respectively connected to the two sides of the frame and each connection plate has an extension which is pivotably connected to respective one of the posts.

A movable member is driven by the motor and movable on the two guide members. Two arms on the movable member have one end thereof pivotably connected to the connection board so that the frame can be pivoted relative to the blase by moving the movable member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
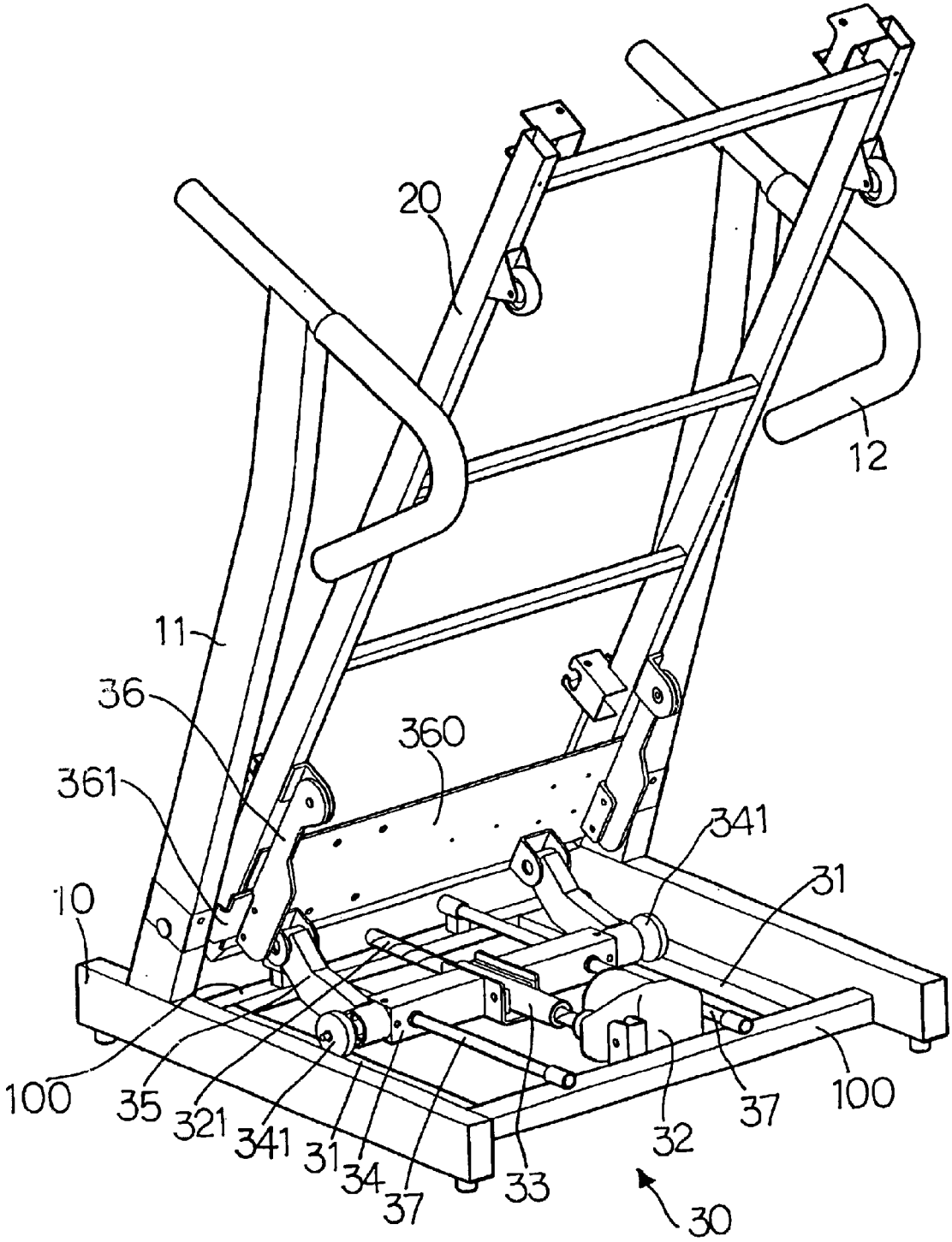
FIG. 1 shows the folding mechanism of the present invention pivots the frame upward.
Figure 2:
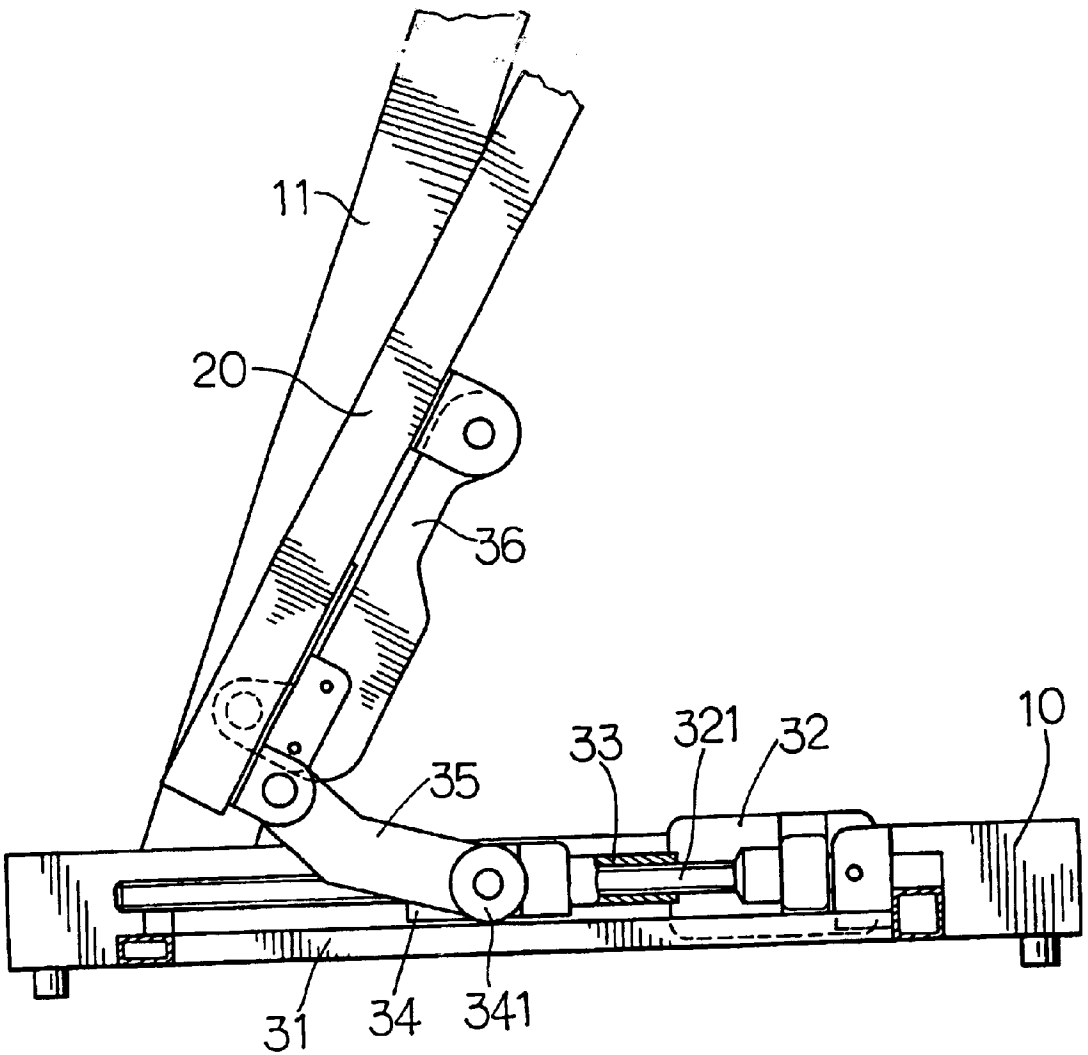
FIG. 2 is a side view to show the frame is pivoted upward by the folding mechanism.

Referring to FIGS. 1 and 2, the treadmill 30 of the present invention comprises a base 10 having two side rails and two transverse bars 100 are connected between the two side rails. Two posts 11 extend from the two side rails and two guide members 31 and two guide rods 37 are respectively connected between the two transverse bars 100. A motor 32 is fixed to the base 10 and drives a threaded rod 321.

A frame 20 for the running belt (not shown) to be installed thereto is located between the two side rails of the base 10 and a connection board 360 is connected between two sides of the frame 20. The connection board 360 is located close to an end of the base 10 and the posts 11. Two connection plates 36 are respectively connected to the respective undersides of the two sides of the frame 20 and each connection plate 36 has an extension 361 which is pivotably connected to respective one of the posts 11.

A movable member 34 has a sleeve 33 fixed thereto and the threaded rod 321 driven by the motor 32 is threadedly extends through the sleeve 33. Two rollers 341 are connected to two ends of the movable member 34 and roll on the two guide members 31. The two guide rods 37 freely extend through the movable member 34 so that the movable member 34 is moved on the two guide members 31 in a stable condition.

Two arms 35 each have one end thereof pivotably connected to the connection board 360 and the other end of each of the arms 35 is connected to the movable member 34.

When the motor 32 is activated, the threaded rod 321 is rotated and drives the movable member 34 to move toward the connection board 360. This movement of the movable member 34 allows the arms 35 to pivot the frame 20 about the connection points of the extensions 361 and the posts 11, so that the frame 20 is pivoted upright.

Figure 3:
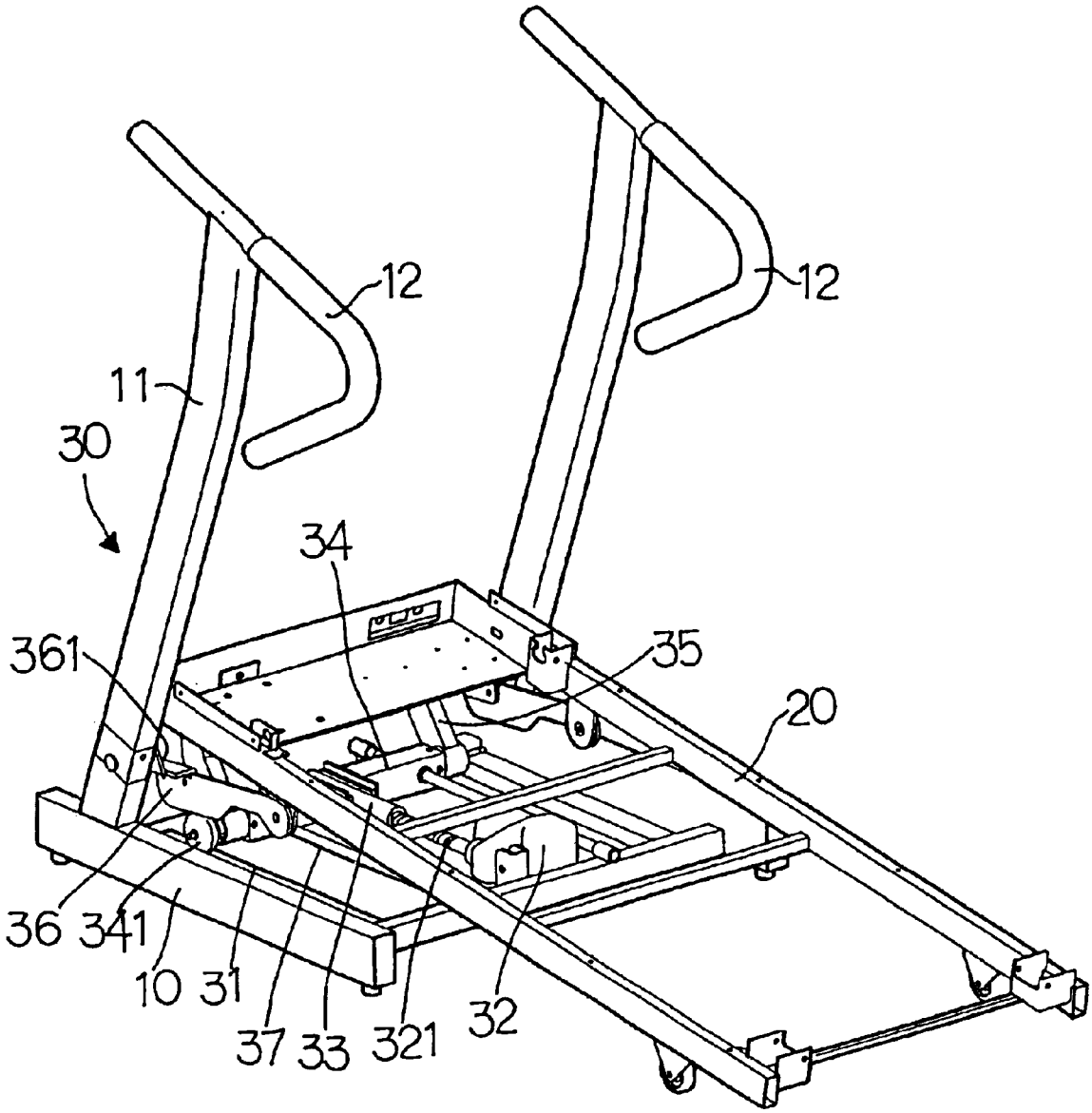
FIG. 3 is a perspective view to show the treadmill when the frame is located in operation position.
Figure 4:
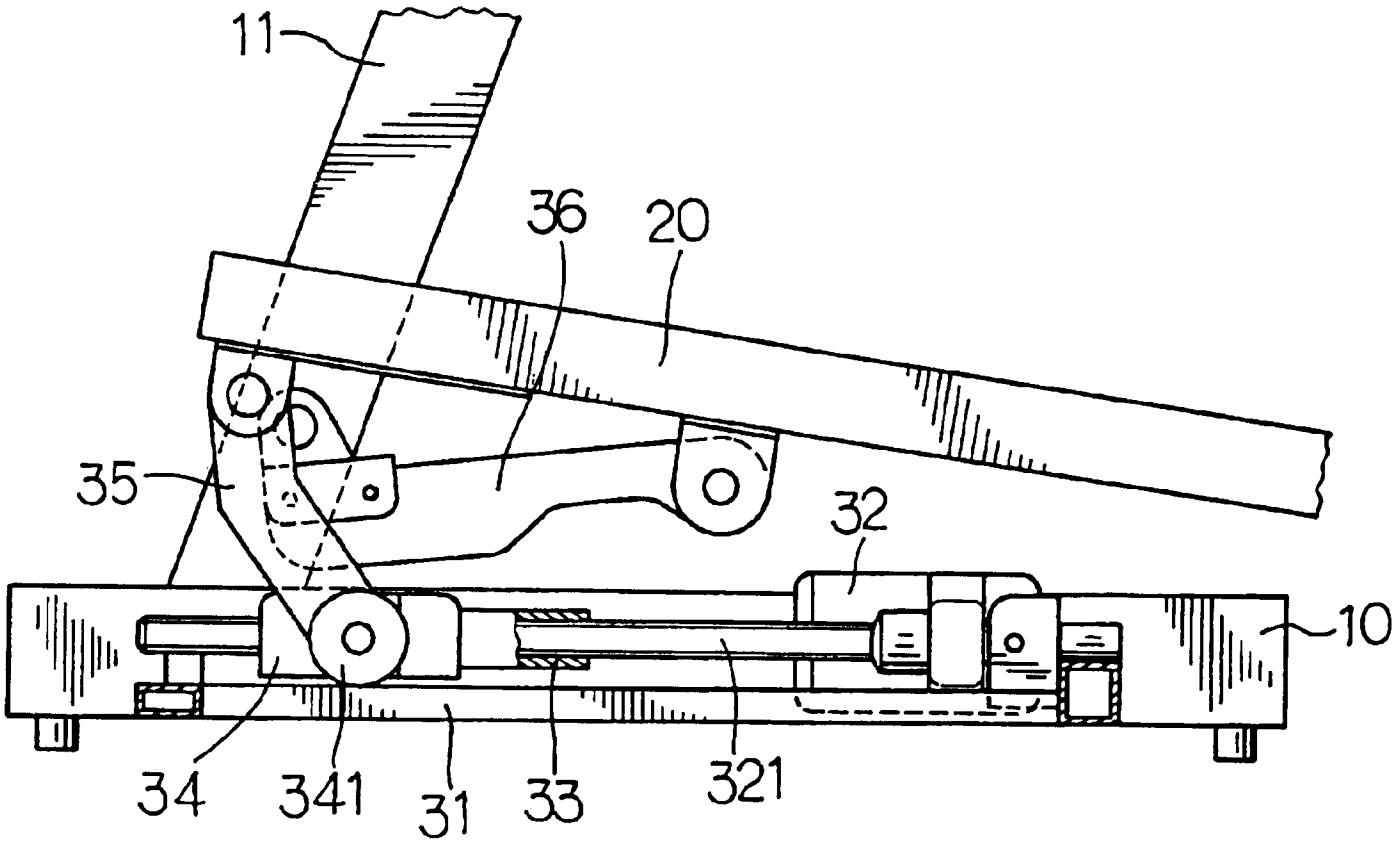
FIG. 4 is a side view to show the folding mechanism supporting the frame.

Referring to FIGS. 3 and 4, when the threaded rod 321 is rotated in an opposite direction, the movable member 34 is moved away from the connection board 360 and this makes the arms 35 to pivot the frame 20 downward to its operation position as shown.

While we have shown and described the embodiment in accordance with the present invention, it should be clear to those skilled in the art that further embodiments may be made without departing from the scope of the present invention.

What is claimed is:

1. A treadmill comprising:

a base having two side rails and two posts extending from the two side rails and two transverse bars connected between the two side rails, two guide members connected between the two transverse bars and a motor fixed to the base;

a frame located between the two side rails of the base and a connection board connected between two sides of the frame, the connection board located close to an end of the base and the posts, two connection plates respectively connected to the two sides of the frame and each connection plate having an extension which is pivotably connected to respective one of the posts, and a movable member driven by the motor and movable on the two guide members, two arms having one end thereof pivotably connected to the connection board and the other end of each of the arms connected to the movable member.

2. The treadmill as claimed in claim 1, wherein two rollers are connected to two ends of the movable member and roll on the two guide members.

3. The treadmill as claimed in claim 1, wherein the movable member has a sleeve fixed thereto and a threaded rod driven by the motor threadedly extends through the sleeve.

4. The treadmill as claimed in claim 1, wherein two guide rods are fixed between the two transverse bars and freely extend through the movable member.

* * * * *